299-13 SR
8/15/78 XR 4,106,814

United States Patent [19]
French

[11] 4,106,814
[45] Aug. 15, 1978

[54] METHOD OF FORMING IN SITU OIL SHALE RETORTS

[75] Inventor: Gordon B. French, Bakersfield, Calif.

[73] Assignee: Occidental Oil Shale, Inc., Grand Junction, Colo.

[21] Appl. No.: 815,799

[22] Filed: Jul. 15, 1977

[51] Int. Cl.[2] ..... E21B 43/24; E21B 43/26; E21C 41/10

[52] U.S. Cl. ..... 299/2; 299/13; 102/23

[58] Field of Search ..... 299/2, 13, 11, 12; 102/23

[56] References Cited

U.S. PATENT DOCUMENTS

| | | | |
|---|---|---|---|
| 3,001,776 | 9/1961 | Van Poollen | 299/2 |
| 3,434,757 | 3/1969 | Prats | 299/2 |
| 3,661,423 | 5/1972 | Garrett | 299/13 X |
| 3,765,722 | 10/1973 | Crumb | 299/2 |
| 3,897,107 | 7/1975 | Haglund | 299/13 |
| 3,917,346 | 11/1975 | Janssen | 299/2 X |
| 3,950,029 | 4/1976 | Timmins | 299/2 |
| 4,025,115 | 5/1977 | French et al. | 299/2 |
| 4,043,596 | 8/1977 | Ridley | 299/2 |
| 4,043,597 | 8/1977 | French | 299/2 |
| 4,043,598 | 8/1977 | French et al. | 299/2 |

*Primary Examiner*—Stephen J. Novosad
*Attorney, Agent, or Firm*—Christie, Parker & Hale

[57] ABSTRACT

A row of horizontally spaced apart in situ oil shale retorts is formed in a subterranean formation containing oil shale. Each row is formed by excavating at least a pair of upper and lower retort access drifts at elevations within the top and bottom boundaries of the retort sites. The access drifts extend through opposite side boundaries of a plurality of retorts in such row. Each retort is formed by excavating upper and lower horizontal voids at the levels of the upper and lower right access drifts, respectively, such voids being excavated laterally from the access drift within the side boundaries of the retort sites. Each retort is formed by explosively expanding formation toward the upper and lower voids within the boundaries of the retort site to form a fragmented permeable mass of particles containing oil shale in each retort. Following formation of each retort, the retort access drifts on the advancing side of the retort are at least partially sealed, preferably with a mass of formation particles covered by a gas impermeable layer and backfilled with a further mass of formation particles.

22 Claims, 5 Drawing Figures

METHOD OF FORMING IN SITU OIL SHALE RETORTS

BACKGROUND OF THE INVENTION

This invention relates to recovery of liquid and gaseous products from oil shale. The term "oil shale" as used in the industry is in fact a misnomer; it is neither shale, nor does it contain oil. It is a sedimentary formation comprising marlstone deposit with layers containing an organic polymer called "kerogen" which upon heating decomposes to produce hydrocarbon liquid and gaseous products. The formation containing kerogen is called "oil shale" herein, and the hydrocarbon liquid product is called "shale oil".

The presence of large deposits of oil shale in the Rocky Mountain region of the United States has given rise to extensive efforts to develop methods of recovering shale oil from kerogen in the oil shale deposits. A number of methods have been developed for processing the oil shale which involve either first mining the kerogen bearing shale and processing the shale on the surface, or processing the shale in situ. The latter approach is preferable from the standpoint of environmental impact inasmuch as the spent shale remains in place, reducing the chance of contamination and the need to dispose of solid wastes.

The recovery of liquid and gaseous products from a subterranean formation containing oil shale has been described in several issued patents, one of which is U.S. Pat. No. 3,661,423, issued May 9, 1972, to Donald E. Garrett, assigned to the assignee of this application and incorporated herein by this reference. That patent describes the in situ recovery of liquid and gaseous carbonaceous products from subterranean formations containing oil shale by preparing an in situ oil shale retort in the subterranean formation. The retort is formed by excavating a production tunnel or drift in the subterranean formation, mining a void in the formation within the boundaries of the in situ retort site, and explosively expanding formation toward the void. This forms a fragmented permeable mass of formation particles containing oil shale, referred to herein as an in situ oil shale retort. Hot retorting gases are passed through the in situ oil shale retort to convert kerogen contained in the oil shale to liquid and gaseous products.

The liquid and gaseous products are cooled by the cooler formation particles in the retort on the advancing side of the retorting zone. The liquid hydrocarbon products, together with water, are withdrawn from the bottom of the retort through a production drift. A process off gas is withdrawn from the bottom of the retort through the production drift. The off gas can contain nitrogen, hydrogen, carbon monoxide, carbon dioxide, water vapor, methane and other hydrocarbons, and sulfur compounds such as hydrogen sulfide. Hydrogen sulfide and carbon monoxide are extremely toxic gases. For this reason it is desirable to prepare in situ oil shale retorts so that workers in a report preparation or development region of the formation are isolated from the off gas in a retorting region of the formation.

It is necessary to constantly provide a supply of fresh air to workers in a retort preparation region of the formation. The particular method used for forming a system of in situ retorts can contribute to the effectiveness and cost of ventilating underground workings when preparing a system of in situ retorts.

A technique for preparing a system of in situ oil shale retorts is described in U.S. Patent 3,001,776 to Van Poollen. That patent describes techniques for forming retorts involving sublevel stoping, shrinkage stopes, sublevel caving or block caving.

Other techniques are disclosed in U.S. Pat. Application Ser. No. 603,704, filed Aug. 11, 1975, now U.S. Pat. No. 4,043,595, and Ser. No. 659,899, filed Feb. 20, 1976, now U.S. Pat. No. 4,043,598, both of which are assigned to the assignee of this application. These applications are incorporated herein by this reference.

It is desirable to develop a safe and economical system for preparing in situ oil shale retorts. Such a method should leave a minimal amount of unfragmented formation and form retorts which can be operated without difficulty.

In carrying out retorting operations it is desirable to isolate the in situ oil shale retorts from one another so that operations in one retort do not affect those in adjacent retorts. In preparing a system of in situ retorts, it is desirable to provide an effective and inexpensive method for isolating the retorts from one another.

SUMMARY OF THE INVENTION

This invention provides a method for forming a plurality of horizontally spaced apart in situ oil shale retorts in a subterranean formation containing oil shale. Such retorts are formed in a row; and each retort site has top, bottom and side boundaries and contains a fragmented permeable mass of formation particles containing oil shale. The retorts are formed by excavating an upper level retort access drift through opposite side boundaries of a plurality of such retort sites, and excavating a lower level retort access drift at an elevation below the elevation of the upper level retort access drift. The lower level retort access drift is excavated through opposite side boundaries of a plurality of such retort sites. A plurality of horizontally spaced apart upper horizontal voids are excavated along the length of the upper level access drift. Each such upper horizontal void is excavated within the boundaries of a separate retort site and has a horizontal cross section substantially larger than the horizontal cross section of the upper level retort access drift. A corresponding plurality of horizontally spaced apart lower horizontal voids are excavated along the length of the lower level access drift, and each such lower void is excavated within the boundaries of a separate retort site at a location spaced vertically below a corresponding upper horizontal void. Each such lower horizontal void has a horizontal cross section substantially larger than the horizontal cross section of the lower level retort access drift. Excavation of such upper and lower voids leaves a zone of unfragmented formation between adjacent vertically spaced apart voids. Such an unfragmented zone has a horizontal free face of deposit adjoining each of the adjacent vertically spaced apart voids. The zone of unfragmented formation is explosively expanded toward the upper and lower horizontal voids to form a fragmented permeable mass of formation particles containing oil shale within the top, bottom and side boundaries of such a retort site.

In one form of the invention, gas flow control through a retort site is provided by forming an upper horizontal void within the boundaries of a first in situ retort site, and forming a lower horizontal void within the same retort site at an elevation below the upper horizontal void. Such vertically spaced apart horizontal voids leave a zone of unfragmented formation between the voids. The unfragmented zone has a horizontal free face of deposit adjoining each of the adjacent vertically spaced apart voids. A separate retort access drift is excavated from each void toward the side boundaries of a second retort site being formed adjacent the first retort site. The zone of unfragmented formation is explosively expanded toward the free faces formed by the upper and lower voids to form a fragmented permeable mass of formation particles containing oil shale within the first in situ retort site. The upper and lower retort access drifts are provided with gas barriers between the fragmented mass in the retort site and the adjacent second retort site to inhibit gas flow between the first and second retort sites.

DRAWINGS

These and other aspects of the invention will be fully understood by referring to the following detailed description and the accompanying drawings, in which.

DETAILED DESCRIPTION

Figure 1:
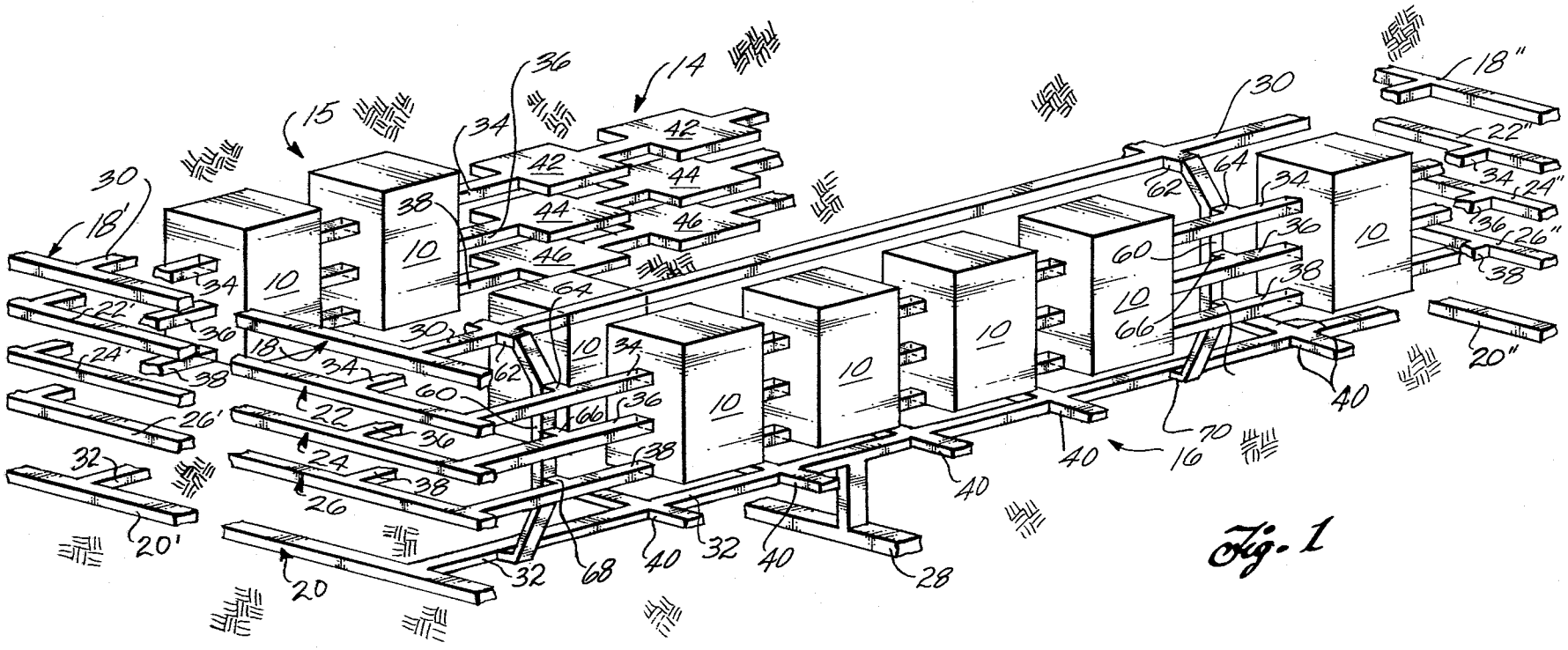
FIG. 1 is a fragmentary perspective view showing a subterranean formation containing oil shale partially prepared for in situ retorting by a method of retort preparation according to principles of this invention.

Referring to the drawings, a system of in situ oil shale retorts 10 is formed in a subterranean formation 12 containing oil shale. The present invention relates to a method of preparing the system of in situ oil shale retorts 10. Each retort, when completed by explosive expansion techniques, comprises a fragmented permeable mass of formation particles containing oil shale having top, bottom and side boundaries. As shown in FIG. 1, the retorts are horizontally spaced apart in rows, leaving barriers of unfragmented formation between adjacent retorts. Each fragmented mass is rectangular in horizontal cross section. In the illustrated embodiment each retort is also rectangular in vertical cross section.

The fragmented mass in each retort 10 is, for clarity, represented in FIG. 1 as a separate three dimensional rectangular shaped box. This drawing is semi-schematic with some dimensions exaggerated for clarity of illustration. For example, in a working embodiment the fragmented mass in a retort can be in the range of 120 to 200 feet square and the barrier of unfragmented formation between retorts can be about 30 feet or less. Likewise the horizontal and vertical dimensions and spacings of drifts and retorts can be different from those illustrated herein.

FIG. 1 illustrates the system of retorts 10 during differing stages of development. In an excavation region 14 of the formation 12, formation has been excavated prior to explosive expansion to form the retorts 10. In a retort preparation region 15 of the formation, formation has been explosively expanded to form the fragmented mass within each retort 10. In a production or retorting region 16 of the formation, retorting of the fragmented mass in each retort 10 is carried out to produce liquid and gaseous products. Excavation, explosive expansion and production in various portions of a tract can occur essentially concurrently.

In preparing the retort system, a main air level drift system 18 is excavated at an upper elevation in the formation, and a main production level drift system 20 is excavated in a lower elevation of the formation below the main air level drift system 18. One or more main retort access level drift systems are formed at elevations within the top and bottom boundaries of the in situ retorts 10 being formed. In the illustrated embodiment there are three vertically spaced apart main retort access level drift systems comprising an upper main retort access level drift system 22, an intermediate main retort level access drift system 24 below the upper main retort level drift system 22, and a lower main retort level access drift system 26 below the intermediate main access drift system 24. The air level drift system is at an elevation above the elevation of the top boundaries of the fragmented masses being formed and the production level drift system in this embodiment is below the elevation of the bottom boundaries of the fragmented masses being formed.

As used herein, the term "level" means one of more generally horizontally extending passages or drifts.

In a working embodiment, the main air level, production level, and retort access level drift systems extend in a rectangular pattern around the perimeter of the portion of the formation under development. The retorts 10 are developed in parallel rows extending perpendicularly between opposite parallel portions of the main drift systems. Extending along first ends of the rows of retorts 10 are a first main air level drift 18, a first production level drift, and first main upper, intermediate and lower retort level access drifts 22, 24 and 26, respectively. Extending along second ends of the rows of retorts 10 are second main air level and production level drifts 18″ and 20″, respectively, and second main upper, intermediate and lower retort level access drifts 22″, 24″, and 26″, respectively.

A gas collection level drift 28 extends at an elevation lower than the elevation of the production level drift system.

A variety of means for access from above ground to the air, production, and retort access drifts can be provided, such as shafts or adits. In a working embodiment, one or more vertical shafts (not shown) provide communication between the main drift systems and above ground. Such a vertical shaft or shafts can be used for ventilation of underground workings, for removal of liquid products of retorting, for transportation of workers and equipment to and from underground workings, for removing excavated formation, and the like.

A separate gas shaft (not shown) provides access to the gas level drift 28, and the gas shaft is isolated from underground workings on the other levels by unfragmented formation.

The air level, production level, and upper, intermediate and lower retort access levels each includes a plurality of parallel, vertically spaced apart cross drifts 30, 32, 34, 36 and 38, respectively, extending perpendicular to the main drifts at opposite ends of the cross drifts. There is a separate set of such upper, intermediate and lower retort access level cross drifts 34, 36 and 38 for each row of retorts 10 being formed. Each of the upper, intermediate and lower retort level access cross drifts extends through the opposite side boundaries of the retorts being formed in such a row.

The portions of the retort access cross drifts 34, 36, and 38 extending between retorts 10 are exaggerated in length in FIG. 1 for clarity. Moreover, only a small portion of the total number of retorts 10 in a tract is shown in FIG. 1 for clarity.

The ends of the air level, production level and retort access level cross drifts open into corresponding first and second main ventilation drifts located at opposite ends of the cross drifts. Although not shown in the drawings, there can be a slight pitch or slope in each production level cross drift 32 from its longitudinal center toward the first and second main production level drifts 20 and 20'' so that liquid products produced during retorting flow toward the main production level drift system.

Each air level cross drift 30 is formed between two adjacent rows of retorts albeit at a higher elevation than the fragmented masses. That is, the air level cross drifts are in a vertical plane that lies between the side boundaries of the fragmented masses in a pair of adjacent rows of retorts. Similarly, each production level cross drift 32 also extends between two adjacent rows of retorts and at at elevation below the bottom boundaries. Each production level cross drift 32 is located directly below a corresponding air level cross drift 30.

Each air level cross drift 30 and each production level cross drift 32 provides ventilation and/or retorting air and a liquid collection system, respectively, for two adjacent rows of retorts, i.e., for the row on either side of such drifts. To this end, a plurality of longitudinally spaced apart stub drifts 40 are excavated perpendicularly away from opposite sides of each production level cross drift 32. Each stub drift 40 is driven to a location below the center of a retort on one side of the production level cross drift. The stub drifts 40 are used to collect liquid and gaseous products from the retorts 10 during production and to convey the products to their corresponding production level cross drift 32 which, in turn, is used to convey liquid products to the main liquid collection drift system 20. Gaseous products are conveyed to the gas collection drift 28. Liquid and gaseous products of retorting reach the stub drifts 40 by way of bored holes 92 (FIG. 2) between such a stub drift and the bottom boundary of the fragmented mass in a retort.

The retorts in each row are formed at horizontally spaced apart locations along each set of upper, intermediate and lower retort access cross drifts 34, 36, and 38 respectively. Barriers 41 (FIG. 2) of unfragmented formation remain between each pair of adjacent retorts in a given row. In preparing each retort 10, formation from within the boundaries of the retort being formed is excavated to form at least one void, leaving a remaining portion of unfragmented formation within the boundaries of the retort being formed. The remaining portion of formation is explosively expanded toward such a void to form a fragmented permeable mass of particles in the retort.

In the embodiment illustrated in the drawings, three vertically spaced apart horizontal voids are formed within the boundaries of each retort site. A separate void is formed at the elevation of each retort level access cross drift. In the embodiment shown, a rectangular upper horizontal void 42 is excavated at the elevation of the upper retort level access cross drift 34, a rectangular intermediate horizontal void 44 is excavated at the elevation of the intermediate retort level access cross drift 36, and a rectangular lower horizontal void 46 is excavated at the elevation of the lower retort level access cross drift 38.

The horizontal cross section of each horizontal void is substantially similar to that of the retort being formed. In the embodiment shown, each retort level access drift extends through the opposite side boundaries of the retort site and such access drift is centered in each horizontal void. Each horizontal void has a horizontal free face having a horizontal cross section substantially larger than the horizontal cross section of the portion of the access drift extending to the void. Each horizontal void desirably has a horizontal cross section substantially similar to the horizontal cross section of the retort being formed. The lower horizontal void 46 is formed at the bottom of the retort being formed, and the intermediate horizontal void 44 is spaced above the lower void 46, leaving a zone of unfragmented formation 48 between the lower and intermediate voids. Similarly, the upper horizontal void 42 is formed above the intermediate void 44, leaving a zone of unfragmented formation 50 between the upper and intermediate voids. The upper zone of unfragmented formation 52 can remain between the top of the upper void 46 and the top boundary of the fragmented mass to be formed.

The voids for each retort are substantially equidistantly spaced apart in the vertical direction and can occupy between about 15 to 25 percent of the total volume of the fragmented mass being formed. In a working embodiment, each of the horizontal voids within a given retort site is substantially rectangular in horizontal cross section, with the outer edges of the voids lying in common vertical planes. In such an embodiment, the retort level cross drifts 34, 36, and 38 are about 30 feet wide and about 20 feet high, and the corresponding horizontal voids are excavated to about the same height. The voids are excavated about 200 feet wide and 200 feet long. The horizontal voids can be large open rooms or can include pillars 53 (shown in FIG. 5) for roof support, if desired. With a void volume having pillars 53, the void is made higher in vertical dimension than a totally open void so that in each instance the void volume for the retort will be essentially the same.

Techniques for forming retorts by horizontal void volumes are more fully described in U.S. Pat. Application Ser. No. 659,899, filed Feb. 20, 1976, now U.S. Pat. No. 4,043,598, and U.S. Patent Application Ser. No. 658,699, filed Feb. 17, 1976, now U.S. Pat. No. 4,043,597, assigned to the assignee of this application and incorporated herein by this reference.

It is desirable to prepare each row of retorts by essentially concurrently excavating the cross drifts for the air level, the production level and the three retort access levels. Such cross drifts are advanced or driven from the first main air level, production level and retort access level drifts 18', 20', 22', 24' and 26' at one end of the row toward the second main drifts 18'', 20'', 22'', 24'' and 26'' at the opposite end of the row. By connecting the opposite ends of the cross drifts to the main air level, production level and retort access level drifts, ventilation for workers in the cross drifts can be effectively provided at relatively low cost. Each production level cross drift is advanced concurrently with or ahead of its corresponding air level and retort access level cross drifts to provide an effective means for removing excavated formation as the cross drifts are being advanced.

Several such cross drifts on each level can be advancing or utilized on each level for efficient utilization of men and equipment.

It can be desirable to complete the air level, production level and retort access level cross drifts for a row of retorts prior to excavating the upper, intermediate and lower voids along each set of retort access cross drifts. Once the cross drifts are completed to the second set of main drifts, the voids for each retort can be formed by a "retreating" system in which they are formed in sequence working backwards from the second set of main drifts toward the first set of main drifts.

Alternatively, the voids and the retort level cross drifts can be formed in an "advancing" system in which the voids and portions of the retort level cross drifts between the voids are concurrently formed as excavation advances from one set of main retort level drifts toward the other set of main retort level drifts.

As excavation advances on the air level, production level and retort access level cross drifts, a number of vertically extending bypass raises 60 are formed along the length of such cross drifts. A separate bypass raise is provided for each group of four retorts in a given row. The first bypass raise 60 in each row is formed ahead of the first group of four retorts in that row. The barriers of unfragmented formation between groups of four retorts in a given row are approximately twice the width of the barriers between retorts in a cluster of four retorts to accommodate the bypass raises. Moreover, for each pair of adjacent rows, the retorts in such rows are formed in two side-by-side groups of four retorts per row, forming clusters of eight retorts along the length of such adjacent rows. The air level and production level cross drifts lie along the middle of such clusters. In the system shown in the drawings, a separate pair of adjacent bypass raises 60 are provided for each cluster of eight retorts. The bypass raises are formed in the thicker barriers between groups of retorts.

Each bypass raise is offset laterally from its corresponding air level, production level and retort access level cross drifts. Although the configuration of each bypass raise can take many forms, in the system shown in the drawings, separate horizontally extending lateral air level stub drifts 62 connect the top of each bypass raise 60 to the air level cross drift 30. Each bypass raise then extends diagonally outwardly and downwardly towards its corresponding set of retort level access cross drifts. Separate horizontally extending lateral retort access level stub drifts 64, 66, and 68 connect each bypass raise to the upper, intermediate and lower retort access level cross drifts, respectively. Each bypass raise extends vertically between the elevations of the retort level cross drifts, and each lateral retort level stub drift opens into the side of the bypass raise and into its corresponding retort access level cross drift. The portion of each bypass raise below the level of the lower retort access level drift extends downwardly and outwardly to a corresponding horizontally extending lateral production level stub drift 70 which connects the bottom of each bypass raise to the side of the production level cross drift 32.

As retort preparation advances, the bypass raises 90 are used as muck passes from the air level and retort level access cross drifts. Excavated formation from driving drifts and preparing voids in retorts is dumped from these drifts downwardly through the bypass raises to the production level cross drift 32 where it can be transported by conveyors or the like through the production level cross drift to the main production level drifts for removal to ground level. As retort preparation and drift driving continues to advance, each bypass raise previously used as a muck pass becomes available as an essentially uninterrupted ventilation air passage between the headings of the air level and retort access level cross drifts and the production level cross drift.

The bypass raises 60 are offset from the air level and the retort access level cross drifts so that there are no dangerous openings in the floors of such cross drifts. Each bypass raise is offset from the production level drift so that excavated formation or muck dumped through the bypass raise does not block the production level cross drift.

After completing each set of upper, intermediate and lower voids in a given retort site, formation is explosively expanded toward such voids to form a fragmented permeable mass of formation particles containing oil shale within the boundaries of the retort. The upper, intermediate and lower voids provide horizontally extending free faces toward which formation particles expand upon blasting. Vertical blasting holes (not shown) are drilled in the zones of unfragmented formation between the upper, intermediate and lower voids. In embodiments where pillars of unfragmented formation are left in the voids, blasting holes are also drilled in such pillars. In some embodiments formation above the upper horizontal void is also expanded toward such a void, and in such case, blasting holes are drilled upwardly into formation above the upper horizontal void. Such blasting holes are loaded with explosive which is detonated in single round for explosively expanding the unfragmented zones toward the horizontal free faces of formation adjacent the voids. Pillars, if present, are explosively expanded before expanding formation between the vertically spaced apart voids. In one embodiment, explosive expansion operations for a given row of retorts are not started until excavation of the entire row of cross drifts and voids is completed between the first and second main drifts at opposite ends of the row. This provides for effective circulation of ventilation air to all underground workings in the row during excavation operations.

Figures 2, 3, 4, 5:
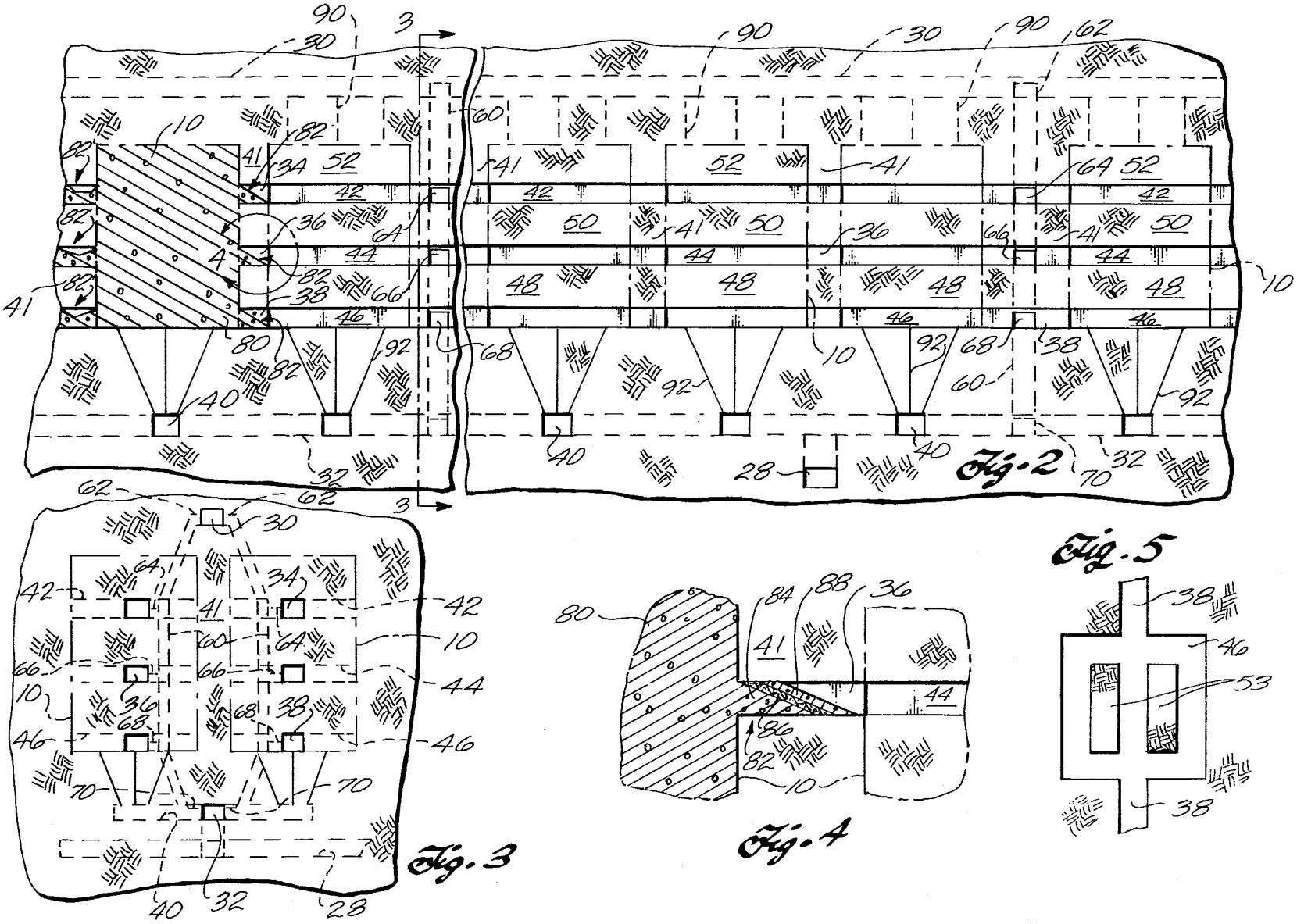
FIG. 2 is a fragmentary schematic view in vertical cross-section showing underground workings in regions of the formation under preparation according to this invention.
FIG. 3 is a schematic view in vertical cross-section taken on line 3—3 of FIG. 2.
FIG. 4 is a schematic view in vertical cross-section showing a gas barrier within the circle 4 of FIG. 2.
FIG. 5 is a top plan view in horizontal cross-section showing an alternate method for forming void volumes according to this invention.

It is desirable to blast in sequence so as to form one retort at a time in a given row, advancing from one end of the row to the other. FIG. 2 illustrates such a procedure in which formation in a retort 80 has been explosively expanded to form a fragmented permeable mass of formation particles containing oil shale. Blasting advances from the retort 80 to the right in FIG. 2, one retort at a time. Between adjacent retorts the regions of unfragmented formation serve as gas barriers to prevent flow of gases between adjacent retorts.

Following the explosive expansion step for forming each retort, gas barriers 82 are provided in the upper intermediate and lower retort level access cross drifts between the previously formed fragmented mass and the side boundary of the next retort being formed. The gas barriers 82 are provided to inhibit gas flow between adjacent retorts during retorting operations so that operations within individual retorts can be controlled independently of retorting operations in adjacent retorts. It is believed that the gas barriers in the portions of the cross drifts between adjacent retorts do not need to be completely impervious to gas flow. Minor cracks or holes can be tolerated in most circumstances since pressure differentials are not large and the cross section through which gas could flow through a seal is quite small by comparison with the cross section available for gas flow through the fragmented mass in each retort.

Each gas barrier 82 is produced, in part, by the explosive expansion step which naturally forms a mass 84 of fragmented formation particles in the retort level access drift adjacent the fragmented mass just formed. In a blasting technique advancing to the right, as in FIG. 2, the portion of each retort level access cross drifts on the right side of each fragmented mass has a pile 84 of fragmented formation particles having a top surface formed substantially at an angle of repose of such particles. Each mass 84 of fragmented formation particles completely covers the openings leading from the fragmented mass to the retort level access drifts leading away from the fragmented mass. If desired, additional fragmented formation particles can be added to the top of a mass resulting from blasting. If desired, excess fragmented formation in the cross drift can be excavated to bring the face of the mass of particles approximately to the angle of repose.

The exposed face of mass 84 of fragmented formation particles is covered with a layer 86 of material which increases the amount by which the gas barrier 82 is substantially impervious to gas flow. The impervious layer 86 can be provided by pouring concrete, or shotcreting or "guniting" the face of the mass 84 of fragmented formation particles with sprayed concrete. Synthetic resins can be be included or added onto the layer for further sealing or damage resistance. Reinforcing steel can be included in the concrete if desired. A layer of impervious clay can be applied to the face of the mass 84. A foot or so of thickness of such materials provides good durability and gas flow resistance in the impermeable layer. The impervious layer 86 serves to inhibit gas flow between the fragmented mass and the retort to be fragmented adjacent to it. The impervious layer 86 is then backfilled or covered with a top buffer layer 88 of mine run fragmented formation particles; or other particles such as spent shale, crushed or ground raw shale or spent shale, or clay can be used to backfill over the impervious layer 86. Clay is desirable since it packs to form an impervious layer. The buffer layer 88 over the impervious layer is provided to inhibit damage which might occur due to shock and impact loading transmitted to the impervious layer 86 when formation is explosively expanded for forming the fragmented mass in the next retort. In forming the next retort, the blast can cause a mass of fragmented particles to cover parts of the backfilled layer 88 of the gas barrier 82 in the cross drift between the retort being formed and the previously formed retort. A buffer layer about two feet thick can adequately protect the impervious layer from blasting damage. Thicker layers can be used if large mine run shale particles form the buffer layer.

As blasting progresses, the openings in the lateral stub drifts leading to the bypass raises 60 also are sealed. This isolates the air level, production level and retort access level cross drifts from one another. The lateral stub drifts leading to the bypass raises are sealed by dumping excavated formation particles into the drifts and pourting concrete or "guniting" the face of the resultant muck pile with sprayed concrete. Backfilling over the concrete can be added if desired.

After fragmentation is completed in each row, the final preparation steps for producing liquid and gaseous products from a retort are carried out. These include drilling a plurality of feed gas inlet passages 90 diagonally downwardly from the air level cross drift 30 to the top boundary of each fragmented mass so that oxygen containing gas can be supplied to each retort during retorting operations. Similarly, a plurality of bore holes or raises 92 are drilling upwardly from the stub drifts 40 adjacent the production level cross drift 32 to the bottom boundary of each fragmented mass for removal of liquid and gaseous products from the retorts to the production level cross drift 32. The air inlet passages 90 and product withdrawal passages can be formed before explosive expansion if desired.

During production or retorting operations, a combustion zone is established in each fragmented mass and the combustion zone is advanced downwardly through each fragmented mass by introducing a feed containing an oxygen supplying gas to the fragmented mass. Combustion gas produced in the combustion zone passes through the fragmented mass to establish a retorting zone on the advancing side of the combustion zone wherein kerogen in the oil shale is retorted to produce liquid and gaseous products. The liquid products and an off gas containing gaseous products pass through the bottom bore holes 92 to the stub drifts 40 of the production level cross drifts 32 and advance to the main production level cross drifts 20 and/or 20''. Because of the pitch or slope of such cross drift, liquid products flow toward the ends of the cross drift and are collected in a sump (not shown) at each end of the production level cross drift. A pump is used for withdrawing liquid products from the sump to above ground. Off gas is withdrawn from the gas collection drift 28 and passed to above ground.

Although described with horizontally extending voids symmetrically straddling the retort level cross drifts like beads on a string, it will be apparent that asymmetrical arrangements can also be suitable. Thus, for example, the retort access level cross drifts could be offset from the centerline of the voids for other designs of muck bypass between the air level and production level. In situ oil shale retorts also can be formed by excavating a vertically extending void within the boundaries of a retort site and explosively expanding remaining formation toward such a void to form a fragmented permeable mass of particles containing oil shale. Such techniques are shown and described, for example, in the aforementioned Patent Application Ser. No. 603,704, now U.S. Pat. No. 4,043,595. Some such techniques involve drifts extending through opposite side boundaries of a retort site and principles of this invention also can applicable thereto.

What is claimed is:

1. A method for recovering liquid and gaseous products from a plurality of in situ oil retorts in a subterranean formation containing oil shale, such an in situ oil shale retort containing a fragmented permeable mass of formation particles containing oil shale, each retort site having top, bottom and side boundaries, the method comprising the steps of:

excavating an upper level retort access drift through opposite side boundaries of a plurality of such retort sites;

excavating a lower level retort access drift at an elevation below the elevation of the upper level access drift, the lower level retort access drift also being excavated through opposite side boundaries of a plurality of such retort sites;

excavating a plurality of horizontally spaced apart upper horizontal voids along the length of the upper level access drift, each such upper horizontal void being excavated within the boundaries of a separate in situ retort site and having a horizontal cross section substantially larger than the horizontal cross section of the upper level retort access drift;

excavating a plurality of horizontally spaced apart lower horizontal voids along the length of the lower level access drift, each such lower horizontal void being excavated within the boundaries of a separate in situ retort site and at a location spaced vertically below a corresponding upper horizontal void, each such lower horizontal void having a horizontal cross section substantially larger than the horizontal cross section of the lower level retort access drift;

leaving a zone of unfragmented formation between adjacent vertically spaced apart upper and lower voids, such an unfragmented zone having a horizontal free face of formation adjoining each of the adjacent vertically spaced apart voids;

explosively expanding such a zone of unfragmented formation toward the horizontal free faces provided by such upper and lower horizontal voids to form a fragmented permeable mass of formation particles containing oil shale within said top, bottom and side boundaries of such a retort; and retorting oil shale in the fragmented mass in each such in situ oil shale retort for producing liquid and gaseous products.

2. The method according to claim 1 in which each such horizontal void has a horizontal cross section substantially similar to the horizontal cross section of the retort being formed.

3. The method according to claim 1 in which each such horizontal void includes a portion extending essentially to all side boundaries of the retort being formed.

4. The method according to claim 1 wherein pillars of unfragmented formation are left within such a void, and in which the pillars are explosively expanded along with explosive expansion of the zone of unfragmented formation.

5. The method according to claim 1 including excavating the upper and lower retort level access drifts essentially concurrently.

6. The method according to claim 1 wherein such horizontal voids on one of such levels are excavated essentially concurrently with at least a portion of the retort level access drift on that level.

7. The method according to claim 1 including excavating at least two ventilation drifts, excavating a retort access drift between such ventilation drifts, and thereafter excavating at least a portion of the horizontal voids along the length of the retort access drift.

8. The method according to claim 1 including:

excavating a first main upper access drift;

excavating a first main lower access drift below the first main upper access drift;

excavating a second main upper access drift at a location in the formation spaced from and parallel to the first main upper access drift;

excavating a second main lower access drift at an elevation in the formation spaced below the second main upper access drift and at a location in the formation spaced from and parallel to the first main lower access drift;

excavating the upper level retort access drift so that opposite ends of such drift open into the first and second main upper access drifts; and excavating the lower level retort access drift so that opposite ends of such drift open into the first and second main lower access drifts.

9. The method according to claim 8 including explosively expanding formation toward each corresponding pair of upper and lower voids in sequence to sequentially form a row of such horizontally spaced apart retorts advancing from the first main access drift toward the second main access drift.

10. The method according to claim 9 in which the upper level and lower level retort access drifts and the voids corresponding to such drifts are excavated between the first and second main access drifts prior to explosively expanding formation to form such retorts.

11. A method for forming a plurality of in situ oil retorts in a subterranean formation containing oil shale, such an in situ shale retort containing a fragmented permeable mass of formation particles containing oil shale, each retort site having top, bottom and side boundaries, the method comprising the steps of:

excavating an upper level retort access drift through opposite side boundaries of a plurality of such retort sites;

excavating a lower level retort access drift at an elevation below the elevation of the upper level access drift, the lower level retort access drift also being excavated through opposite side boundaries of a plurality of such retort sites;

excavating a plurality of horizontally spaced apart upper horizontal voids along the length of the upper level access drifts, each such upper horizontal void having a horizontal cross section substantially similar to the horizontal cross section of such a retort and having a horizontal cross section substantially larger than the horizontal cross section of the upper level retort access drift;

excavating a plurality of horizontally spaced apart lower horizontal voids along the length of the lower level access drift, each such lower horizontal void having a horizontal cross section substantially similar to the horizontal cross section of such a retort site and being excavated at a location spaced vertically below a corresponding upper horizontal void, each such lower horizontal void having a horizontal cross section substantially larger than the horizontal cross section of the lower level retort access drift;

leaving a first zone of unfragmented formation between adjacent vertically spaced apart upper and lower voids, and a second zone of unfragmented formation above the upper horizontal void and the top boundary of such a retort site;

explosively expanding such first and second zones toward the upper and lower horizontal voids to form a fragmented permeable mass of formation particles containing oil shale within said top, bottom and side boundaries of such a retort site; and retorting oil shale in the fragmented mass in each such in situ oil shale retort for producing liquid and gaseous products.

12. The method according to claim 11 wherein pillars of unfragmented formation are left within such a void, and in which the pillars are explosively expanded along with explosive expansion of such zones of unfragmented formation.

13. The method according to claim 11 wherein such horizontal voids on one of such levels are excavated essentially concurrently with at least a portion of the retort level access drift on that level.

14. The method according to claim 11 including excavating at least two ventilation drifts, excavating a retort access drift between such ventilation drifts, and thereafter excavating such horizontal voids along the length of the retort access drift.

15. A method for forming a plurality of in situ oil retorts in a subterranean formation containing oil shale, such as in situ oil shale retort containing a fragmented permeable mass of formation particles containing oil shale, each retort site having top, bottom and side boundaries, the method comprising the steps of:

excavating an upper level retort access drift through opposite side boundaries of a plurality of such retort sites;

excavating a lower level retort access drift at an elevation below the elevation of the upper level access drift, the lower level retort access drift also being excavated through opposite side boundaries of a plurality of such retort sites;

excavating a plurality of horizontally spaced apart upper horizontal voids along the length of the upper level access drift, each such upper horizontal void including a portion extending essentially to all side boundaries of such a retort site and having a horizontal cross section substantially larger than the horizontal cross section of the upper level retort access drift;

excavating a plurality of horizontally spaced apart lower horizontal voids along the length of the lower level access drift, each such lower horizontal void including a portion extending essentially to all side boundaries of such a retort site and being excavated at a location spaced vertically below a corresponding upper horizontal void, each such lower horizontal void having a horizontal cross section substantially larger than the horizontal cross section of the lower level retort access drift;

leaving a zone of unfragmented formation between adjacent vertically spaced apart upper and lower voids, said unfragmented zone having a horizontal free face of formation adjoining each of the adjacent vertically spaced apart voids;

explosively expanding said zone of unfragmented formation toward the horizontal free faces provided by such upper and lower horizontal voids to form a fragmented permeable mass of formation particles containing oil shale within said top, bottom and side boundaries of such a retort; and retorting oil shale in the fragmented mass in each such in situ oil shale retort for producing liquid and gaseous products.

16. The method according to claim 15 in which the upper and lower voids within such a retort site are substantially rectangular in horizontal cross section, with the outer edges of such upper and lower voids lying in common vertical planes.

17. The method according to claim 15 in which the upper and lower retort access drifts are essentially centered in their corresponding upper and lower horizontal voids.

18. The method according to claim 15 including excavating at least two ventilation drifts, excavating a retort access drift between such ventilation drifts, and thereafter excavating such horizontal voids along the length of the retort access drift.

19. A method for forming a plurality of in situ oil retorts in a subterranean formation containing oil shale, such an in situ oil shale retort containing a fragmented permeable mass of formation particles containing oil shale, each retort site having top, bottom and side boundaries, the method comprising the steps of:

excavating an upper level retort access drift through opposite side boundaries of a plurality of such retort sites;

excavating an intermediate level retort access drift at an elevation below the elevation of the upper level access drift, the intermediate level retort access drift being excavated through opposite side boundaries of a plurality of such retort sites;

excavating a lower level retort access drift at an elevation below the elevation of the intermediate level retort access drift, the lower retort access drift being excavated through opposite side boundaries of a plurality of such retort sites;

excavating a plurality of horizontally spaced apart upper horizontal voids along the length of the upper level access drift, each such upper horizontal void being excavated within the boundaries of a separate in situ retort site and having a horizontal cross section substantially larger than the horizontal cross section of the upper level retort access drift;

excavating a plurality of horizontally spaced apart intermediate horizontal voids along the length of the intermediate level access drift, each such intermediate horizontal void being excavated within the boundaries of a separate in situ retort site and at a location spaced vertically below a corresponding upper horizontal void, leaving a first zone of unfragmented formation between such upper and intermediate voids, each such intermediate horizontal void having a horizontal cross section substantially larger than the horizontal cross section of the intermediate level retort access drift;

excavating a plurality of horizontally spaced apart lower horizontal voids along the length of the lower level access drift, each such lower horizontal void being excavated within the boundaries of a separate in situ retort site and at a location spaced vertically below a corresponding intermediate horizontal void, leaving a second zone of unfragmented formation between such lower and intermediate voids, each such lower horizontal void having a horizontal cross section substantially larger than the horizontal cross section of the lower level retort access drift;

explosively expanding said first and second zones of unfragmented formation toward the upper, intermediate and lower horizontal voids to form a fragmented permeable mass of formation particles containing oil shale within said top, bottom and side boundaries of such a retort; and retorting oil shale in the fragmented mass in each such in situ oil shale retort for producing liquid and gaseous products.

20. The method according to claim 19 in which each such horizontal void includes a portion extending essentially to all side boundaries of the retort being formed.

21. The method according to claim 19 including excavating at least two ventilation drifts, excavating a retort access drift between such ventilation drifts, and thereafter excavating such horizontal voids along the length of the retort access drift.

22. The method according to claim 19 wherein such horizontal voids on one of such levels are excavated essentially concurrently with at least a portion of the retort level access drift on that level.

* * * * *

UNITED STATES PATENT AND TRADEMARK OFFICE

CERTIFICATE OF CORRECTION

PATENT NO. : 4,106,814

DATED : AUGUST 15, 1978

INVENTOR(S) : GORDON B. FRENCH

It is certified that error appears in the above-identified patent and that said Letters Patent are hereby corrected as shown below:

Abstract, line 9, "right" should be -- retort --.

Column 9, line 60, "pourting" should be -- pouring --.

Column 12, line 17, -- oil -- should be inserted after "situ" and before "shale".

Column 13, line 10, "as" should be -- an --.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*